US006901879B2

(12) United States Patent
Burlando

(10) Patent No.: US 6,901,879 B2
(45) Date of Patent: Jun. 7, 2005

(54) REFLECTIVE WARNING AND INFORMATIONAL MEMBER FOR TRAFFIC SIGN POSTS

(76) Inventor: Albert A. Burlando, 2 Joy Dr., Hackettstown, NJ (US) 07840-9600

( * ) Notice: Subject to any disclaimer, the term of this patent is extended or adjusted under 35 U.S.C. 154(b) by 0 days.

(21) Appl. No.: 09/948,238

(22) Filed: Sep. 7, 2001

(65) Prior Publication Data

US 2002/0059894 A1 May 23, 2002

Related U.S. Application Data

(63) Continuation of application No. 09/626,762, filed on Jul. 27, 2000, now abandoned, which is a continuation of application No. 09/245,268, filed on Feb. 5, 1999, now Pat. No. 6,158,379.

(51) Int. Cl.[7] ..... G09F 17/18; E01F 9/00

(52) U.S. Cl. ..... 116/63 R; 116/209; 116/63 P; 40/607; 40/612

(58) Field of Search ..... 116/63 P, 63 R, 116/209, 173; 404/6, 9, 10, 14; 40/584, 606, 607, 612

(56) References Cited

U.S. PATENT DOCUMENTS

| | | | | | |
|---|---|---|---|---|---|
| 3,509,652 | A | * | 5/1970 | Kern | 40/612 |
| 3,570,376 | A | * | 3/1971 | Overton et al. | 116/63 R |
| 4,245,922 | A | * | 1/1981 | Auriemma | 256/1 |
| 4,298,292 | A | * | 11/1981 | Sweeney | 256/1 |
| 4,445,803 | A | * | 5/1984 | Dixon | 404/10 |
| 4,460,161 | A | * | 7/1984 | Grenga | 116/63 R |
| 4,723,758 | A | * | 2/1988 | Gehrig | 256/1 |
| 4,779,955 | A | * | 10/1988 | Schmanski | 116/63 R |
| 5,125,194 | A | * | 6/1992 | Granger | 403/2 |
| 5,437,907 | A | * | 8/1995 | Peil et al. | 404/10 |
| 5,679,437 | A | * | 10/1997 | Hackworth et al. | 359/538 |
| 6,109,754 | A | * | 8/2000 | Steele | 359/520 |
| 6,233,898 | B1 | * | 5/2001 | Burlando | 116/63 P |

* cited by examiner

*Primary Examiner*—Christopher W. Fulton
*Assistant Examiner*—Yaritza Guadalupe-McCall
(74) *Attorney, Agent, or Firm*—Pitney Hardin LLP

(57) ABSTRACT

A supplemental reflective and informational member securable within the C-shaped channel of existing traffic sign posts to provide additional reflective safety warning, extend the life of the traffic sign function from fading due to UV sun rays and to provide information of a safety, directional or commercial nature.

5 Claims, 4 Drawing Sheets

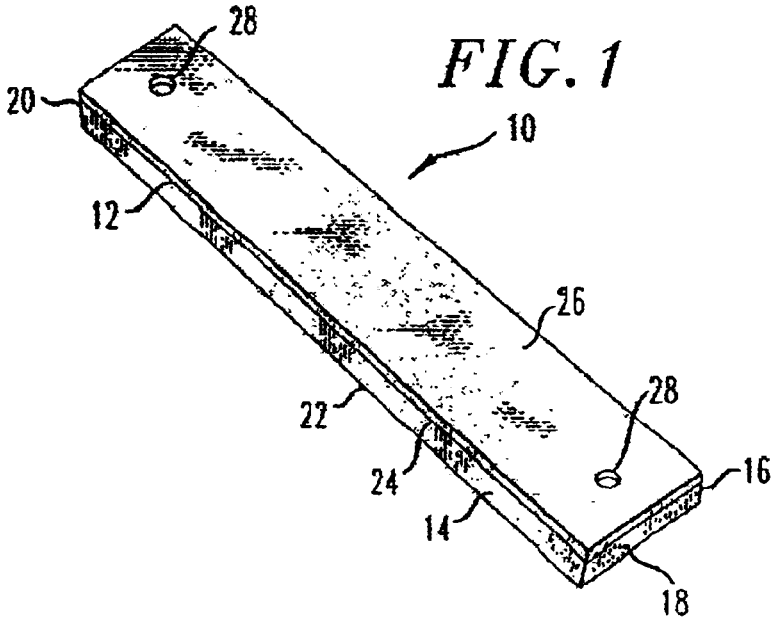
FIG. 1
FIG. 3
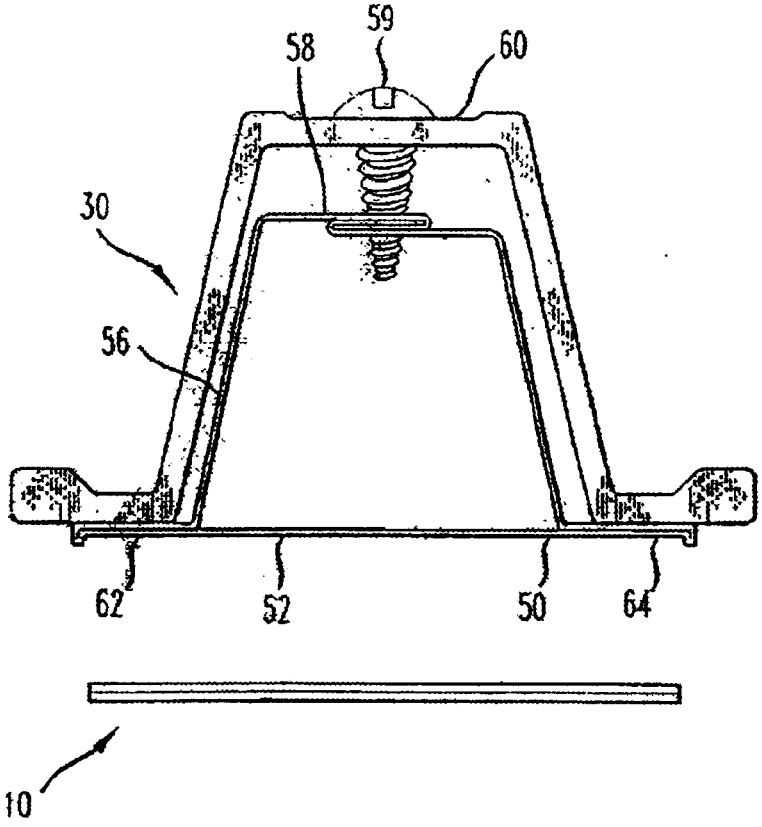

FIG. 4
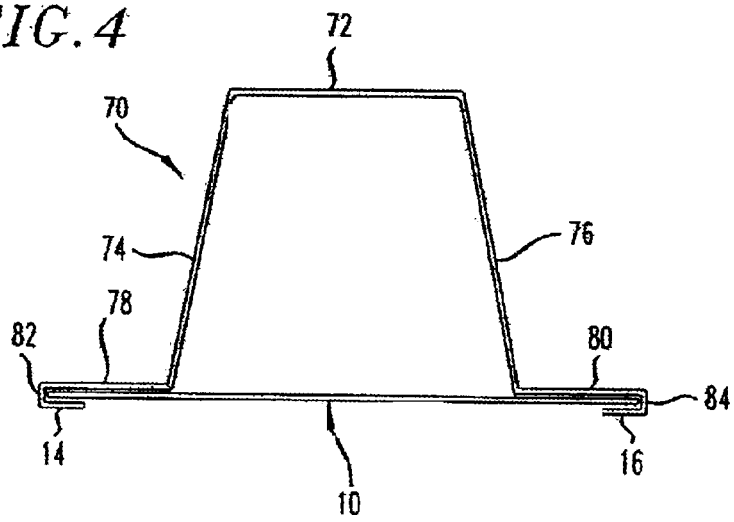
FIG. 5
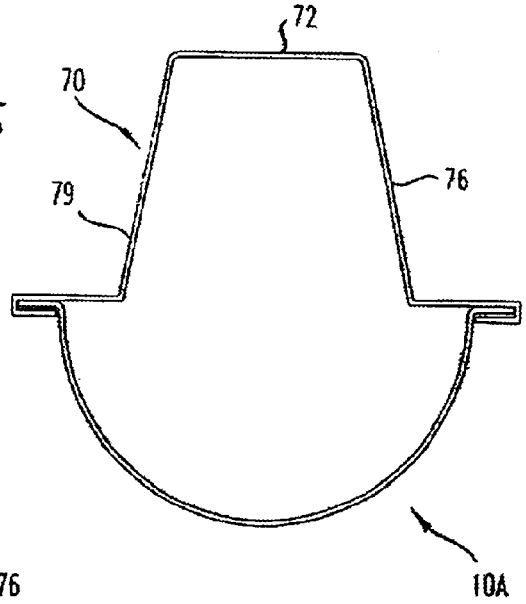
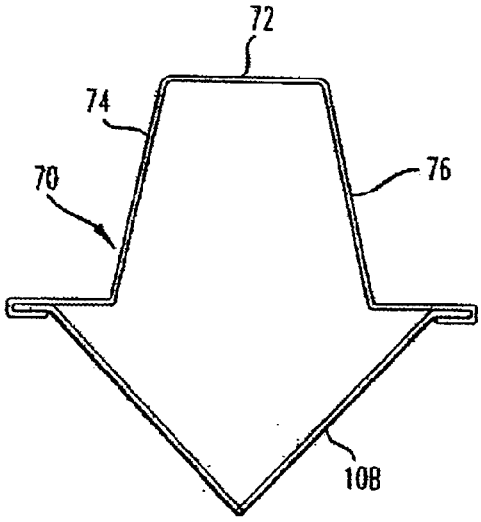
FIG. 6

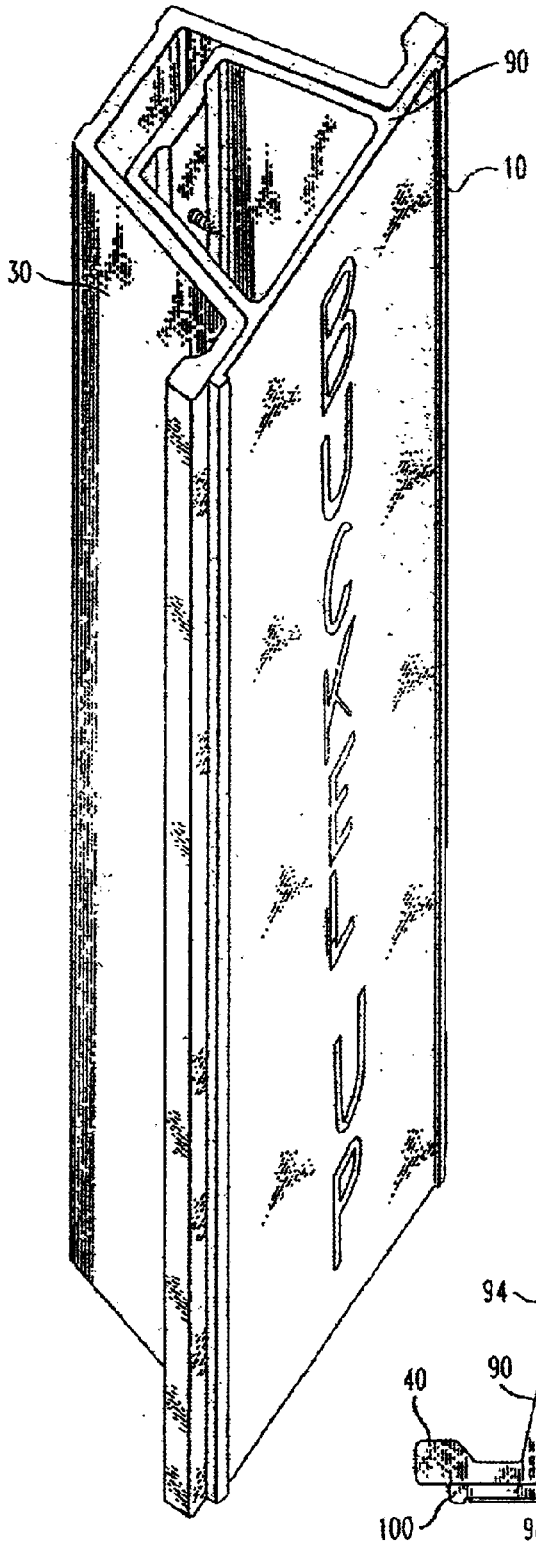
FIG. 8
FIG. 7
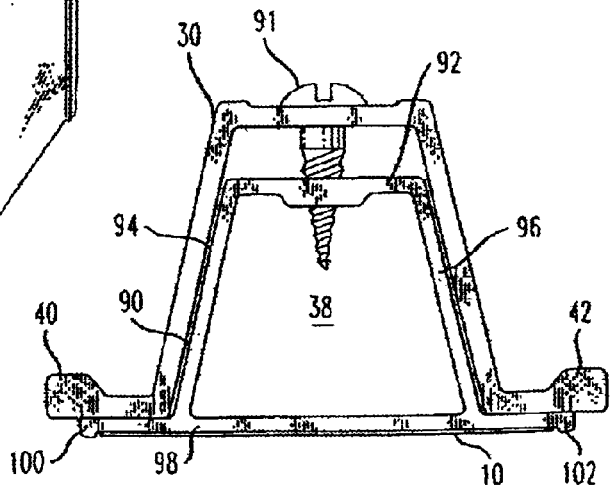

REFLECTIVE WARNING AND INFORMATIONAL MEMBER FOR TRAFFIC SIGN POSTS

CROSS-REFERENCE TO RELATED APPLICATION

This is a continuation of U.S. patent application Ser. No. 09/626,762, filed Jul. 27, 2000, now abandoned, which is a divisional of U.S. patent application Ser. No. 09/245,268, filed Feb. 5, 1999, now U.S. Pat. No. 6,158,379.

BACKGROUND OF THE INVENTION

1. Field of the Invention

The present invention relates to the field of traffic sign posts and in particular to a reflective and/or fluorescent member securable within the C-shaped channel of existing sign posts to provide additional reflective safety warning and to extend the life of the sign function and in a second embodiment, a reflective and/or fluorescent member and mounting member which mates with the C-shaped section of the existing sign post so as to provide the same additional safety reflection and also information.

2. Description of the Prior Art

Traffic sign posts are encountered every day by motorists regardless of the length of their journey. The sign posts are positioned on the sides of the highway or road and at intersections and support signs which advise motorists of the actions they should take, e.g. STOP, YIELD, ONE WAY, TURN, etc., and as delineators to identify the road shoulders. The traffic signs mounted on the traffic sign posts are also color coded and reflective. Stop signs are red, informational signs are black and white, and warning signs are yellow.

The traffic sign posts themselves have been standardized over the years and are generally C-shaped in cross section having opposing outstanding flanges. A plurality of apertures are positioned in the rear face of the traffic sign post and the traffic signs themselves are mounted by means of a threaded fastener passing through the sign which is juxtaposed against the flanges, the fastener extending through apertures in the rear face and secured.

These standardized traffic sign posts can be found on every street and road in a community and in most instances their sole purpose is to support the traffic sign itself. One problem encountered with traffic signs is that as a result of their exposure to sunlight and in particular, the UV light from the sun, the color and reflectivity of the signs decreases over time such that the warranty offered by companies which manufacture the signs is limited often to less than seven years. One object of the present invention is to provide an additional reflective capability to the traffic sign post which can extend the useful life of the traffic sign as a warning device.

Additionally the existing traffic sign post is one dimensional in that it serves one mission, that of supporting the traffic sign when in fact because of their placement and frequency, they could impart additional information. In the second embodiment of Applicant's invention, a mounting member is utilized, the cross section of which is such that it would mate within the C-shaped cross section of the traffic sign post and present a vertical support of varying widths and lengths on the sign post for receipt of the reflective and/or fluorescent member so as to provide additional warning reflectivity and which could also have messages positioned thereon of a safety, directional, or commercial nature.

In either embodiment, the reflective character of the traffic sign would be enhanced by the fact that a reflector and/or fluorescent member which would be color coded to the type of sign, would be vertically aligned and secured to the traffic sign post so as to better gain the visual attention of the motorist.

OBJECTS OF THE INVENTION

An object of the present invention is to provide for a novel reflective and/or fluorescent member securable to existing traffic sign posts which reflective member enhances the warning capability intended to be given to the motorist by the traffic sign.

Another object of the present invention is to provide for a novel reflective and/or fluorescent member which in a first embodiment, will extend the life of the traffic sign in that the reflective member will be positioned on the traffic sign post such that it is partially shielded from sunlight yet visible to a motorist.

A further object of the present invention is to provide for a novel reflective and/or fluorescent member and mounting member which mounting member has a cross section such that it can mate within the C-shaped traffic sign post and present a vertical face for receipt of a member having a reflective capability and/or an informational capability.

A still further object of the present invention is to provide for a novel reflective member and mounting member which can be easily mated to existing traffic sign posts without any modifications to the existing traffic sign post.

SUMMARY OF THE INVENTION

A reflective and/or fluorescent member mountable to a traffic sign post to augment the warning capability of the traffic sign mounted on the traffic sign post, the reflective and/or fluorescent member in a first embodiment is mounted in the recessed C-channel of the traffic sign post and is partially shielded from the sun during the day and thereby extends the life of the traffic sign which fades from the action of UV sunlight, and in a second embodiment, the reflective and/or fluorescent member is mounted on the face of a mounting member, the mounting member having a cross section such that it mates with the C-shaped channel of the traffic sign post, the edges of the mounting member being flanged outwardly and the reflective and/or fluorescent member may also include information of a safety, directional or commercial nature.

BRIEF DESCRIPTION OF THE DRAWINGS

These and other objects of the present invention will become evident, particularly when taken in light of the following illustrations wherein:

FIG. 1 is a perspective view of the reflective member of the present invention;

FIG. 3 is a top exploded view of a second embodiment utilizing a mounting member for installation of a reflective member on a traffic sign post;

FIG. 4 is an alternative embodiment of the mounting member for the installation of reflective member on the traffic sign post;

FIG. 5 is an alternative embodiment of the reflector member in conjunction with the mounting member of FIG. 4.

FIG. 6 is another embodiment of the reflector member in conjunction with the mounting member of FIG. 4.

FIG. 7 is an alternate embodiment of the mounting member fabricated of plastic; and FIG. 8 is a partial perspective view of the installation of the mounting member of FIG. 5 and the reflective member to the traffic sign post.

DETAILED DESCRIPTION OF THE DRAWINGS

Figure 2:
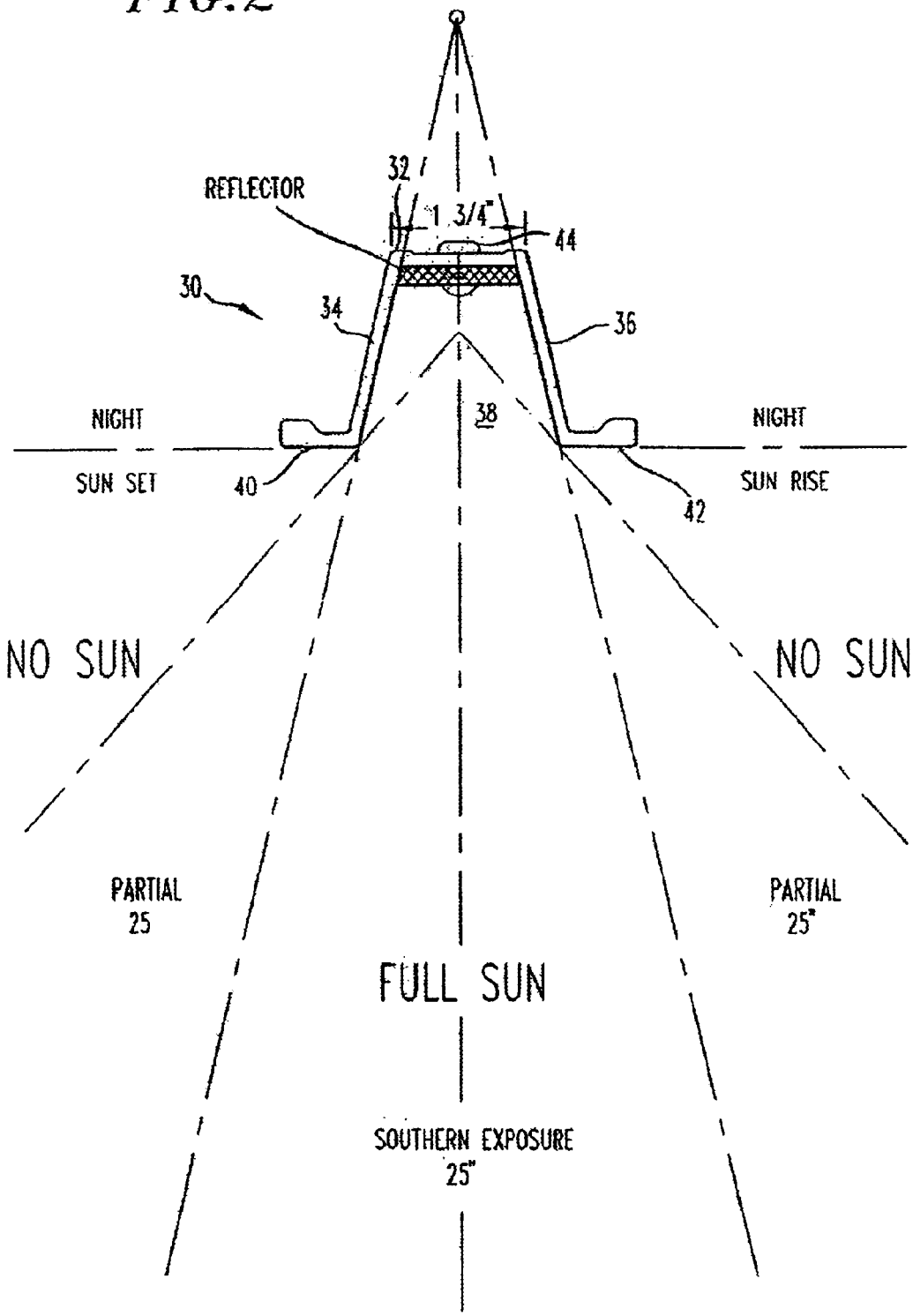
FIG. 2 is a top view of a first embodiment of a reflective member of the present invention positioned on a traffic sign post.

FIG. 1 is a prospective illustration of a reflective and/or fluorescent member 10 (hereinafter collectively referred to as reflective) of the present invention which may be used in either embodiment of the invention as set forth hereafter. Reflective member 10 is comprised of a base member 12 formed of UV plastics such as high density polyethylene or metal such as aluminum. Base member 12 is generally elongate and defined by side walls 14 and 16, end walls 18 and 20 and a lower surface 22 and upper surface 24. Bonded to upper surface 24 is a reflective layer 26. Reflective layer 26 can be comprised of a reflective thermoplastic material or a reflective metallic material. Preferably the reflective color of reflective layer 26 will be matched to the color of the traffic sign mounted on the traffic post. For instance, a yellow reflective layer 26 associated with a traffic post supporting a curve sign, a red reflective layer 26 associated with a traffic post supporting a stop sign.

The reflective member 10 would be fabricated of a desired standardized length and could easily be cut to the exact length required at the time of installation with installation by mechanical fasteners, i.e. pop rivets through apertures 28 formed through base 12 and reflective layer 26.

FIG. 2 is a top view of a traffic sign post 30 with reflective member 10 mounted therein. Sign post 30 is commonly referred to in the trade as a C-channel post in that it is defined by a rear wall 32, and side walls 34 and 36 which emanate from rear wall 32 and diverge from each other defining a trapezoidal space 38. Side walls 34 and 36 terminate with opposing flanges 40 and 42 which are in the same plane and define the front face of traffic sign post 30. Rear wall 32 is formed with a plurality of spaced apart apertures along its entire vertical face.

In practice, the traffic sign (not shown) would be juxtaposed against the front face of traffic sign post 30 as defined by flanges 40 and 42 and a fastening means would extend through the traffic sign, through trapezoidal area 38 and through an aperture in the rear face 32 of traffic sign post 30.

In the first embodiment of applicant's invention, applicant's reflective member 10 would be cut to the desired length for the particular traffic sign post in question. For instance, if one wished to have the reflective member 10 extend from the ground to a point proximate the lower edge of the traffic sign, the installer would cut the reflective member 10 to that length. At that point two or more apertures 28 would be punched into reflective member 10 for the receipt of a fastening means and reflective member 10 would be positioned within the trapezoidal area 38 against rear wall 32 such that the reflective layer 26 was positioned towards the front face of the traffic sign post 30 as defined by flanges 40 and 42. A pop rivet or other suitable fastener 44 would be utilized to secure the reflective member 10 against the rear wall 32.

In the first embodiment of the invention, the reflective member as mounted heretofore, extends the life the traffic sign by providing additional reflectivity and warning to the motorist without suffering the same rate of fading that the traffic sign encounters. This is achieved by the fact that the reflective member 10 is mounted against the rear wall 32 of traffic sign post 30 and therefore it is partially shielded from sunlight. FIG. 2 illustrates a worst case scenario wherein the traffic sign post is positioned with the traffic sign on a direct southern exposure. In such a situation the traffic sign would be exposed to sunlight from sunrise until sunset. The reflective member 10 would be partially shielded from the sun by sidewalls 34 and 36. The entire reflective member 10 would only be subjected to full sunlight during the mid hours of the day and on either side of the mid hours of the day only portions of the reflective member would be subject to direct sunlight, while in certain early hours of the day and late hours of the day, the reflective member 10 would be fully shielded. Since the reflective member 10 would not be subjected to the UV rays of the sun for the entire day such as would the traffic sign attached to the traffic sign post 30, reflective member 10 can extend the warning capability of the traffic sign by supplementing the reflective capability of the traffic sign with a longer lasting reflective capability.

FIG. 2 illustrates the worst case scenario where the traffic sign post and traffic sign are oriented in a southerly direction. The benefits of the reflective member would increase in those situations where the traffic sign posts where oriented in a different direction.

The second embodiment of applicant's reflective warning and information member would utilize a reflective member as illustrated in FIG. 1, but would utilize a mounting member on which the reflective member 10 would be secured with the mounting member being secured to the traffic sign post 30. The second embodiment provides for additional reflective capability and an information capability, however, since it is not recessed, the extended life of the traffic sign is not provided.

FIG. 3 illustrates a first variation of the second embodiment. FIG. 3 is a top view of traffic sign post 30 with a mounting member 50 secured thereto. The mounting member 50 is fabricated from aluminum, steel or other suitable metal as a one piece rolled form which when fabricated is defined by a front face 52, side walls 54 and 56 and a rear face 58 formed with a crimp lock 60. In roll forming mounting member 50, front face 52 is formed with two opposing flanges 62 and 64 and side walls 54 and 56 are divergent from rear face 58 such that mounting member 50 substantially conforms to the trapezoidal area 38 defined by traffic sign post 30.

In this configuration, the reflective member 10 would be affixed to the front face 52 of support member 50. Further, in this configuration, the reflective member would be wider than that of the first embodiment and could if desired, have information of a safety, directional or commercial nature printed thereon. As is illustrated from FIG. 3, mounting member 50 would be positioned within the C-shaped channel of traffic sign post 30 and a threaded fastener 59 would be introduced through the rear face 32 of traffic sign post 30 and engage the rear face 58 of mounting member 50.

FIG. 4 illustrates a second variation of the second embodiment of applicant's invention. This second variation is similar to the first variation with the exception that there is no front face formed on the mounting member. Mounting member 70 as illustrated in FIG. 4 is elongate in nature and has a rear face 72, side walls 74 and 76 which emanate from rear face 72 and diverge. Side walls 74 and 76 are bent to form opposing flanges 78 and 80 which extend outwardly in opposite directions from sidewall 74 and 76. Flanges 78 and 80 are further bent or turned in so as to form opposing slots 82 and 84. In this variation of the second embodiment, the mounting member 70 again conforms to the trapezoidal area 38 defined by traffic sign post 30 for insertion therein. Flanges 78 and 80 are juxtaposed against flanges 40 and 42 of traffic sign post 30. In this configuration, the reflective member 10 is introduced onto mounting member 70 by sliding the reflective member side walls 14 and 16 downwardly within slots 82 and 84. The installer would crimp slots 82 and 84 at the lower end of mounting member 70 to maintain reflective member 10 in position. In this version, reflective member 10 would again conform to the color of the traffic sign mounted on the traffic sign post 30 and could also include informational messages. This particular version of the second embodiment is particularly adaptable and useful when the local authority wishes to position informational messages which may be of a temporary nature, such as directions to an event or a temporary ban on parking. The mounting member of FIG. 4 could be fabricated from steel, aluminum or a suitable thermoplastic-and reflective member 10 may have a substrate of metal, aluminum or thermoplastic with a reflective layer laminated thereon.

FIGS. 5 and 6 are top views of the mounting member 70 as illustrated in FIG. 4. Mounting member 70 in FIGS. 5 and 6 is identical to that of FIG. 4. In FIGS. 5 and 6 the reflective member 10A has a curved face and the reflective member 10B as illustrated in FIG. 6 has an angled face. Both reflective members 10A and 10B have a suitable substrate as identified with respect to reflective member 10 with a reflective layer adhered or laminated thereto as with reflective member 10. The curved or angular cross section of reflective member 10A or 10B is a further safety feature, particularly at night or in low visibility situations. Vehicle headlights on automobiles are normally set at a height of between 18 and 24 inches from street level. The Manual on Uniform Traffic Control Devices states that traffic control signs shall be mounted at a height of at least five feet measured from the bottom of the traffic sign to the near edge of the pavement. The same manual provides that on expressways this minimum height is seven feet. Thus, the vehicle's headlights do not illuminate the planar sign face when the vehicle is near the sign. By forming a reflective member with a curved cross section such as reflective member 10A or an angular cross section such as reflective member 10B and color coding the reflective member there is provided additional warning to the motorist that a sign exists and that some action is required by the motorist.

FIG. 7 is an alternate version of a second embodiment of the mounting member of the present invention. The mounting member 90 illustrated in FIG. 7 is constructed of an extruded thermoplastic. Mounting member 90 has a rear face 92, side walls 94 and 96 which emanate from rear face 92 and diverge, terminating in front face 98. Front face 98 has opposing flanges 100 and 102 which are in juxtaposition with flanges 40 and 42 of traffic sign post 30. Mounting member 90 is fabricated of extruded thermo-plastic and is trapezoidal in cross sectional area such that it is receivable within trapezoidal area 38 as defined by traffic sign post 30. A fastening means 91 would be introduced through rear face 32 of traffic sign post 30 and engage rear face 92 of mounting member 90 to maintain its position within the C-shaped channel and with flanges 100 and 102 being juxtaposed to flanges 40 and 42 of the traffic sign post. The reflective member 10 would be adhered or laminated to front face 98 and again in this embodiment, would include informational messages if desired.

In order to increase the structural integrity of mounting member 90, particularly with respect to the fastening means 91, mounting member 90 can be extruded so as to provide additional thickness in the form of a longitudinal rib 93 along rear face 92 for receipt of a fastening means in the form of a threaded fastener.

FIG. 8 is a prospective view illustrating mounting member 90 secured to traffic sign post 30. In this embodiment the mounting member provides for an adhered or laminated reflective member 10 which also provides for an informational message. In the illustrations, the message is "Buckle Up" which might be appropriate in conjunction with a stop sign wherein the reflective member 10 would be red with the safety message in white letters.

Mounting member 90 can also be used as a stand alone delineator at the sides of driveways as a self-supporting member with reflector member to delineate the edge of the driveway.

While the invention has been described in connection with an exemplary embodiment thereof, it will be understood that many modifications will be apparent to those of ordinary skill in the art; and that this application is intended to cover any adaptations or variations thereof. Therefore, it is manifestly intended that this invention be only limited by the claims and the equivalents thereof.

I claim:

1. An improved traffic sign post and traffic sign mounted thereon providing additional reflective warning for motorists wherein said traffic sign post has a rear wall, having a plurality of vertically spaced apart apertures positioned therein, two divergent side walls extending from said rear wall and defining a vertical C-shaped channel, said two divergent side walls having opposing outwardly extending flanges parallel with said rear wall, the improvement comprising:

a reflective warning member secured to said traffic sign post which comprises a substrate having a reflective layer bonded thereto, said reflective warning member having a width proximate to the width of said rear wall of said C-shaped channel, said reflective warning member secured to said rear wall in said vertical C-shaped channel between said two divergent side walls, said substrate of said reflective warning member comprises high density polyethylene or aluminum, said reflective member being color coded to match the color of the traffic sign.

2. A method of providing extended life to a traffic sign from the UV ray effects of the sum and providing supplementary reflective warning to motorists in conjunction with said traffic sign, wherein said traffic sign is mounted on a traffic sign post, said sign post having a rear wall, having a plurality of vertically spaced apart apertures positioned therein, two divergent side walls extending from said rear wall and defining a vertical C-shaped channel, and said two divergent side walls having opposing outwardly extending flanges parallel with said rear wall, said method comprising:

a) forming a vertical reflective warning member having a width proximate to the width of said rear wall of said traffic sign post between said two divergent side walls;

b) positioning said reflective warning member against said rear wall of said traffic sign post;

c) securing said reflective warning member to said rear wall of said traffic sign post.

3. The method in according with claim 2 wherein said vertical reflective member is comprised of a substrate of high density polyethylene and a reflective layer bonded thereto.

4. The method in accordance with claim 2 wherein said vertical reflective member is comprised of aluminum and a reflective layer bonded thereto.

5. The method in accordance with claim 2 wherein said reflective member is color coded to match the color of the traffic sign.

* * * * *